US007798214B2

(12) United States Patent
Schmitt et al.

(10) Patent No.: US 7,798,214 B2
(45) Date of Patent: Sep. 21, 2010

(54) SUBSURFACE FORMATION MONITORING SYSTEM AND METHOD

(75) Inventors: Benoit Schmitt, Massy (FR); Christian Chouzenoux, St. Cloud (FR); Kamal Babour, Asker (NO); Paul Beguin, Colombes (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/185,308

(22) Filed: Aug. 4, 2008

(65) Prior Publication Data

US 2009/0038793 A1 Feb. 12, 2009

(30) Foreign Application Priority Data

Aug. 9, 2007 (EP) ..... 07291004

(51) Int. Cl.
*E21B 47/00* (2006.01)
*G01V 3/00* (2006.01)

(52) U.S. Cl. ..... 166/250.01; 166/66; 175/40; 175/50; 324/376; 324/300

(58) Field of Classification Search ..... 175/40, 175/50; 73/152.01; 324/376, 300; 166/250.01, 166/66

See application file for complete search history.

(56) References Cited

U.S. PATENT DOCUMENTS

2002/0036085 A1 3/2002 Bass et al.
2003/0058127 A1 3/2003 Babour et al.
2004/0263175 A1* 12/2004 Chouzenoux et al. ..... 324/368
2005/0016771 A1* 1/2005 Mayes et al. ..... 175/48

FOREIGN PATENT DOCUMENTS

| | | |
|---|---|---|
| EP | 1609947 | 12/2005 |
| WO | WO0165067 | 9/2001 |
| WO | WO2005124397 | 12/2005 |

* cited by examiner

*Primary Examiner*—Kenneth Thompson
*Assistant Examiner*—Yong-Suk Ro
(74) *Attorney, Agent, or Firm*—Myron K. Stout

(57) ABSTRACT

A subsurface formation monitoring system comprises a conductive piping positioned within a borehole extending into the formation, a surface installed power and communication module, a downhole installed conductive casing or tubing sub comprising sensor(s) mounted on the sub, a data communication module for wireless communication of sensor measurements to the surface module, and a battery for providing power to the data communication module and the sensor. The surface module is coupled to the conductive piping and to a grounded return electrode coupled to the formation, and comprises an alternate current generator that defines an ingoing signal path along the conductive piping and sub, the ingoing signal flowing from the surface module to the sub and transmitting power from the generator to the sub. A return signal comprising sensor measurements is transmitted through a return signal path flowing from the sub to the surface module.

10 Claims, 6 Drawing Sheets

SUBSURFACE FORMATION MONITORING SYSTEM AND METHOD

FIELD OF THE INVENTION

The invention relates to a subsurface formation monitoring system. Such system comprises downhole sensors measuring physical characteristics of fluids flowing within a borehole extending into the subsurface formation, or of the subsurface formation around the borehole, or of the casing/tubing within the borehole. The downhole sensors are powered by surface equipments and also transmit the measurements to surface equipments in a wireless manner.

Another aspect of the invention relates to a subsurface formation monitoring method. A particular application of the system and method according to the invention relates to the oilfield services industry.

BACKGROUND OF THE INVENTION

In order to exploit hydrocarbon well location, drilling, casing, cementing and perforating operations are sequentially carried out above a hydrocarbon geological formation comprising underground reservoir. During production, hydrocarbon fluids are extracted from the underground reservoir via the casing and production tubing. The knowledge of various physical parameters characterizing the reservoir, the geological formation and the fluids flowing into the casing/tubing is necessary in order to allow a controlled and optimized exploitation of the reservoir during the production operation.

Various reservoir monitoring techniques are known for long-term reservoir management. Typically, these techniques involve sensors permanently installed downhole and continuously measuring said physical parameters. Generally, the operation of the sensors requires power and transmission of measurements to surface equipments for further processing and use.

First types of system are wired systems comprising cables directly connecting each sensor to surface equipments. However, such wire systems have various drawbacks, in particular casing installation complication, cable connection reliability, cable wearing and breaking risk, cable damaging risk during perforation, safety, etc. . . .

Second types of systems are wireless system. Document EP 1 609 947 describes such a system comprising an interrogating tool moved within the internal cavity formed by the casing. The interrogating tool is linked to surface equipments by means of a conductive cable. The interrogating tool provides wireless power supply to the sensor and wireless communication with a data communication means coupled to the sensor. However, such a wireless system requires an interrogating tool which may be difficult to insert and move during production operation. Document WO 01/65066 and EP 0 964 134 describe another system in which an electrical signal is provided to the sensor by means of an insulated conduit in the well. The electrical signal enables power supply between the surface equipments and the sensors. Document WO 01/65066 further describe a downhole module comprising a spread spectrum transceiver for data transmission between a downhole module including sensors and the surface equipments. However, such a wireless system requires an electrically insulated conduit in the well and induction chokes in order to impede current flow on casing and tubing.

SUMMARY OF THE INVENTION

It is an object of the invention to propose a system and method that overcomes at least one of the drawbacks of the prior art.

According to an aspect, the invention relates to a subsurface formation monitoring system comprising:

- a conductive piping structure comprising either a conductive casing or a non conductive casing fitted with a conductive tubing, the conductive piping being positioned within a borehole extending into the subsurface formation,
- a surface installed power and communication module, and
- a downhole installed conductive casing or tubing sub comprising at least one sensor mounted on the sub, a data communication module for wireless communication of the sensor measurements to the surface installed power and communication module, and a powering means for providing power to the data communication module and the sensor.

The surface installed power and communication module is coupled to the conductive piping and to a grounded return electrode coupled to the subsurface formation, and comprises an alternate current generator so as to define an ingoing signal path along the conductive piping and sub, and a return signal path into the subsurface formation around the borehole. The ingoing signal flows from the surface installed power and communication module to the downhole installed sub.

The ingoing signal transmits power from the alternate current generator to the downhole installed conductive casing or tubing sub. A return signal comprising the sensor measurements is transmitted through a return signal path flowing from the downhole installed sub to the surface installed power and communication module into the subsurface formation around the borehole.

Alternatively, the ingoing signal may further comprise commands sent from the surface installed power and communication module to activate functions of the downhole installed conductive casing or tubing sub.

The system may further comprise a conductive tubing within the piping and a conductive or insulating packer coupling the tubing to the piping.

The system may further comprise a downhole intermediate module coupling the surface installed power and communication module to the at least one sensor.

The downhole intermediate module may be connected to the surface installed power and communication module via the conductive tubing, or via a cable. Alternatively, the downhole intermediate module may further comprise a conductive centralizer for contacting the piping or the casing sub. Alternatively, the downhole intermediate module may be installed into a tool comprising a conductive centralizer for contacting the piping or sub, the tool being suspended by a wireline to the surface equipment, the wireline being connected to the surface installed power and communication module.

The powering means may be coupled to a toroid mounted in the sub concentrically to the borehole. Alternatively, the powering means may be coupled above and below an insulating gap mounted in the sub concentrically to the borehole.

The powering means may be a power harvesting means or an energy storage means.

The sensor measures characteristic parameter of the formation, or in the borehole, or of the piping, or of the tubing. The sensor may be a pressure sensor, a temperature sensor, a resistivity or conductivity sensor, a casing/tubing stress or strain sensor, a pH sensor, a chemical sensor, a flow rate sensor, an acoustic sensor, or a geophone sensor.

According to another aspect, the invention relates to a method of monitoring a subsurface formation comprising the steps of:

positioning a conductive piping within a borehole extending into the subsurface formation, the piping comprising either a conductive casing or a non conductive casing fitted with a conductive tubing, positioning a downhole installed conductive casing or tubing sub, the sub comprising at least one sensor, a data communication module for wireless communication of the sensor measurements to a surface installed power and communication module, and a powering means for providing power to the data communication module and the sensor.

The method further comprises the steps of:

coupling the surface installed power and communication module to the conductive piping and to a grounded return electrode coupled to the subsurface formation, injecting an alternate current signal so as to define an ingoing signal path along the conductive piping and sub, the ingoing signal flowing from the surface installed power and communication module to the downhole installed sub, and a return signal path into the subsurface formation around the borehole, the return signal flowing from the downhole installed sub to the surface installed power and communication module.

The ingoing signal transmits power from the alternate current generator to the downhole installed conductive casing or tubing sub. The return signal transmits the sensor measurements to the surface installed power and communication module.

The method may further comprise the step of positioning an intermediate module downhole and coupling the surface installed power and communication module to the at least one sensor via the intermediate module.

The method may further comprise the steps of:

running a tool comprising the downhole intermediate module, the tool being suspended by a wireline to the surface equipment, the wireline being connected to the surface installed power and communication module, deploying a conductive centralizer from the tool for contacting the piping or sub and propagating the alternate current signal into the piping or sub.

Thus, the invention enables to have a potential difference with a return outside the piping structure sufficient to communicate with and/or to power the downhole sensors system by injecting signal at an alternate current through the piping structure/casing/tubing and the formation.

Further, the invention enables permanent monitoring without the necessity of having cable integrated within or outside the piping structure. Further, the invention avoids the necessity of having insulated section of piping structure or tubing for wireless power supply and data transmission.

Furthermore, as the power is provided by a power supply device always positioned at the surface and not downhole anymore, the electronic parts of the downhole devices are considerably simplified, and the downhole sensors system can be powered continuously, thus improving measurements stability and reliability.

These and other aspects of the invention will be apparent from and elucidated with reference to the embodiments described hereinafter.

BRIEF DESCRIPTION OF THE DRAWINGS

The present invention is illustrated by way of example and not limited to the accompanying figures, in which like references indicate similar elements.

DETAILED DESCRIPTION OF THE INVENTION

In the following description, the terminology "sensor" means any electronic or electric device that may measure physical parameters characterizing the reservoir, the geological formation, the fluids flowing into the casing/tubing and/or the casing/tubing. As an example, the sensor may be pressure sensor, temperature sensor, resistivity or conductivity sensor, casing/tubing stress or strain sensor, pH sensor, chemical sensor, flow rate sensor, acoustic sensor, geophone, etc. . . . As an extension, the sensor may also be understood as any electronic, electrical or electro-mechanical device permanently installed downhole and controllable in a wireless manner, e.g. a controllable valve. The sensors may be installed inside or outside the casing/tubing, even in the flowing fluid or inside the formation or reservoir at any appropriate depth in the hydrocarbon well.

In the following description, the terminology "wireless" means that at least a first entity transmits power and/or data to at least a second entity without being connected together by a standard cable. In particular, the terminology "wireless" comprises the transmission of power and/or data by means of the conductive casing/tubing.

FIGS. 1 to 5 show, in a highly schematic manner, an onshore hydrocarbon well location and surface equipments SE above a hydrocarbon geological formation GF after a borehole BH drilling operation has been carried out, after a piping structure 2 has been run, after completion operations have been carried out and exploitation has begun. The borehole BH extends into the geological formation GF which comprises a hydrocarbon reservoir RS located downhole. The piping structure 2 is installed within the borehole BH and secured during completion operation by cementing the annulus CA formed between the piping structure and the borehole wall. When exploitation has begun, a fluid mixture FM flows from selected zones of the hydrocarbon geological formation GF out of the well from a well head CT. The well head may be coupled to other surface equipment (not shown) known in the art and that will not be further described. For example, the other surface equipment may typically comprise a chain of elements connected together like pressure reducers, heat exchangers, burners, etc. . . .

Figure 1:
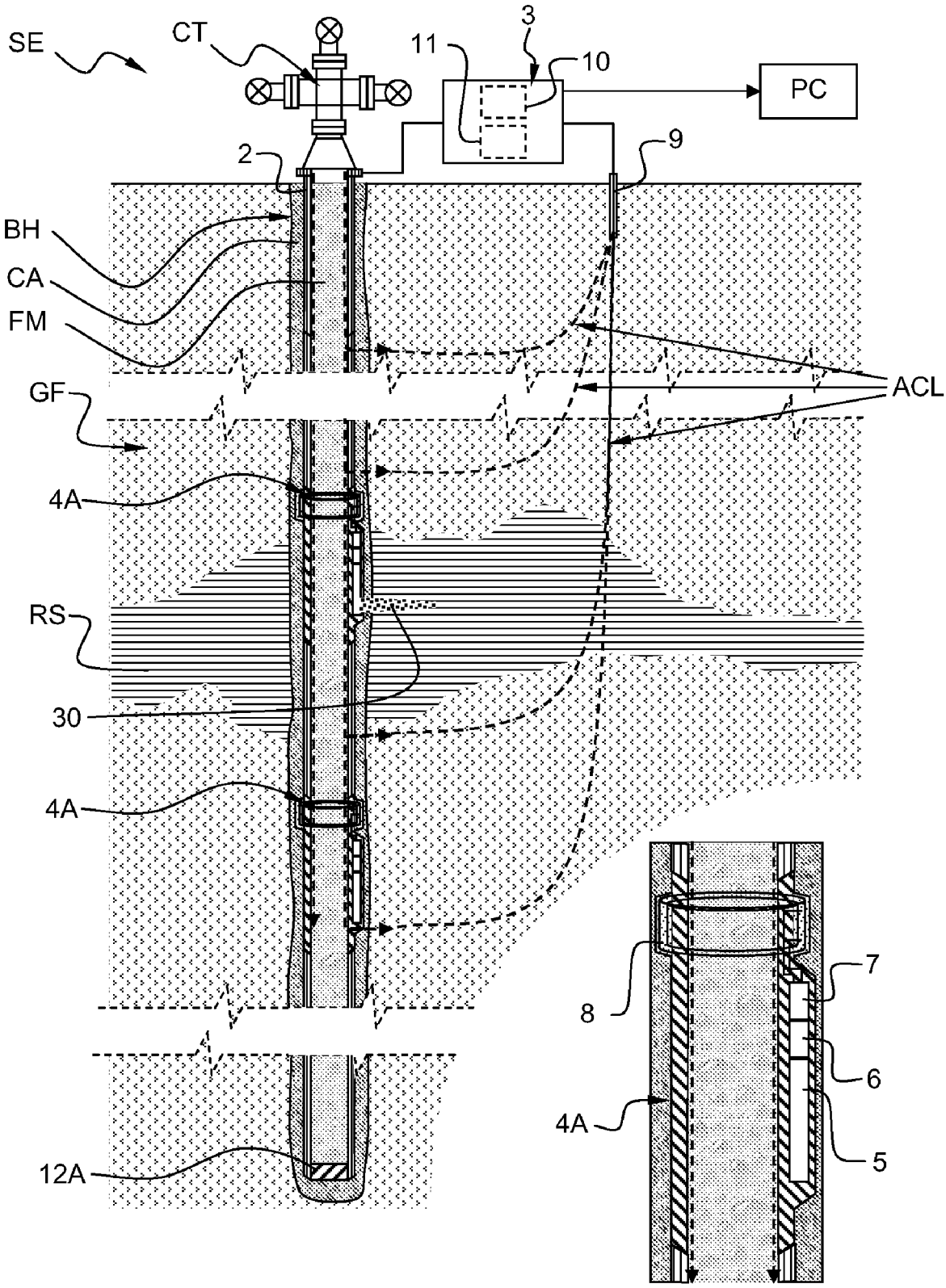
FIG. 1 schematically illustrates an onshore hydrocarbon well location and a monitoring system of the invention according to a first embodiment.
Figure 2:
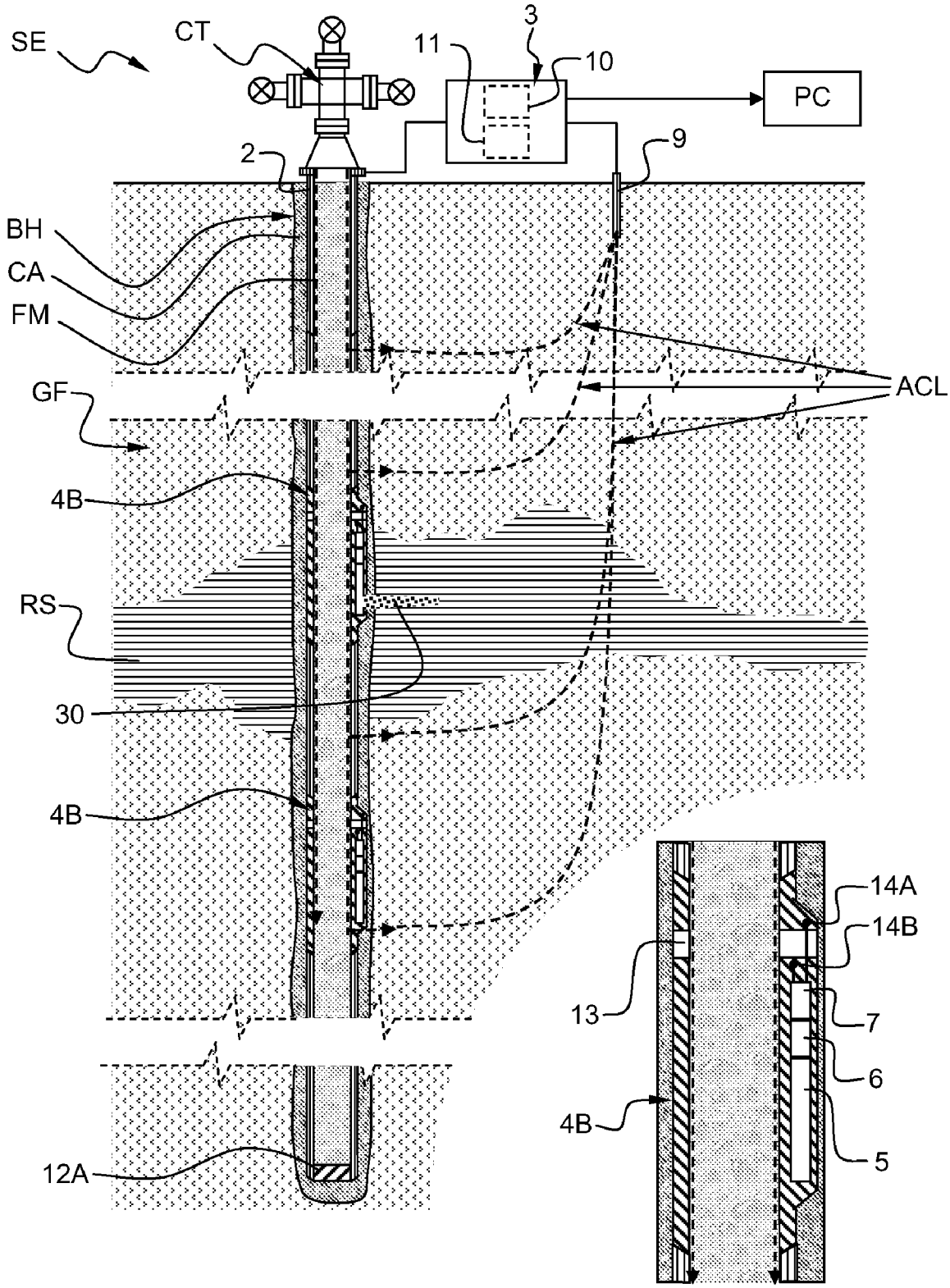
FIG. 2 schematically illustrates an onshore hydrocarbon well location and a monitoring system of the invention according to a second embodiment.

As show in the drawings, the piping structure 2 may comprise a conductive casing (stainless steel pipe). As an alternative not shown in the drawings, the piping structure may comprise a non conductive casing (e.g. plastic pipe, fiber glass pipe, etc. . . . ) fitted with a conductive tubing, FIGS. 1 and 2 depict the monitoring system of the invention according to a first and a second embodiment, respectively. At least one casing sub 4A or 4B is installed downhole. It is conventionally coupled by its threaded ends to adjacent piping portions during the piping structure running operation. A sensor 5, a data communication module 6 and a powering means 7 are mounted integrally within the sub and coupled together. The powering means 7 provide power to the data communication module 6 and the sensor 5. The powering means may be a power harvesting means or an energy storage means (battery, rechargeable battery, fuel cells, capacitor, etc).

The data communication module 6 enables wireless communication of the sensor measurements to a power and communication module 3. Though the Figures show two casing subs 4A or 4B, it is apparent for a skilled person that this is not limitative as less or more casing subs can be mounted along the piping structure 2. Further, each casing sub may comprise one or more sensors.

The power and communication module 3 is installed at the surface. The power and communication module 3 comprises a power supply and a communication device. The power supply comprises a voltage source or a current source supplying a time varying signal. Advantageously, the power supply may be an alternate current generator 10, for example providing a signal of 300 $V_{RMS}$, 10 $A_{RMS}$ and at a frequency from around 1 Hz to around 10 kHz. In the high frequency range, a skin effect may be generated in the conductive piping/tubing/casing. The communication device may be a modulator-demodulator (modem) device 11. Advantageously, the modem of the power and communication module operates according to a spread-spectrum scheme in order to tolerate noise and low signal. The power and communication module 3 is coupled by a first connector to the piping structure 2 and by a second connector to a grounded return electrode 9. The grounded return electrode 9 is inserted into the soil at the surface and is thus coupled to the subsurface formation GF. The alternate current generator 10 injects an alternate current signal in the piping structure. The frequency is selected in order to optimize the signal to noise ratio (SNR) of the communication and power.

The power and communication module 3, the piping structure 2, the subs 4A or 4B and the geological formation GF form a path for the signal (indicated as dotted lines). The signal mainly propagates along the conductive casing or the conductive tubing of the piping structure. Further, as the cement provides an imperfect isolation, the signal also propagates through the cement and the formation, and returns towards the grounded return electrode. In particular, firstly, an ingoing signal path is defined along the conductive casing of the piping structure 2 and the subs 4A or 4B. The ingoing signal flows from the surface installed power and communication module 3 to the downhole installed subs 4A. Secondly, a plurality of return signal paths ACL is formed from the piping structure leaking point into the subsurface formation GF around the borehole BH. The return signals flow from the conductive casing 2 of the piping structure, in particular from the downhole installed sub 4A or 4B towards the grounded return electrode 9 coupled to the surface installed power and communication module 3. The powering means 7 receive the electrical power from the ingoing signal and provide power to the data communication module 6 and the sensor 5.

As a first alternative, the data communication module 6 modulates its impedance which affects the level of the current in the time varying current lines up to the return electrode. The impedance modulation is performed such that the characteristic parameters measured by the sensor are encoded into the return signal. This modulation is decoded at the surface by the modulator/demodulator device 11.

As a second alternative, the data communication module injects a modulated current (in amplitude, or in frequency, or in phase or any combination of these).

The extracted measurements can then be stored, processed, displayed and/or further used by appropriate storing/processing/displaying means, e.g. a personal computer PC in order to allow a controlled and optimized exploitation of the reservoir. The casing sub 4A or 4B may further comprise means to perforate the piping structure in order to create a perforation 30 hydraulically coupling the reservoir RS to the sensor.

FIG. 1 schematically depicts the monitoring system of the invention according to a first embodiment. The casing sub 4A comprises a toroid 8. The toroid 8 is a toroidal transformer mounted in the sub 4A concentrically to the borehole BH and encompassing the piping structure 2 in order to maximize the current flowing inside the toroidal. Advantageously, the toroid has a high impedance in order to minimize signal attenuation. The powering means 7 are connected to the toroid 8 and receive the electrical power generated by the ingoing alternate current signal in the toroid. The ingoing signal generates a voltage in the toroid 8 according to electromagnetic induction principle. This voltage is used to supply power to the sensor 5. This voltage may also be used to communicate with the sensor 5 in order to send commands for activating functions of the sub or sensors, e.g. activation command for firing the means to perforate the piping structure. The return signal is modified by being further modulated by the data communication module 6 so that data information related to the sensor measurements can be encoded into the signal and transmitted to the surface equipment.

As an alternative (not shown), the toroid may be used as a transmitter. The data communication module 6 may encode the sensor measurements into a signal. The signal is transmitted by the toroid as current lines propagating along the conductive piping structure towards the power and communication module 3. Then, the modem device 11 will decode the sensor measurements from the received current lines.

It is to be noted that the amplitude of the signal may be importantly decreased close to the casing shoe 12A relatively to close to the surface. This does not affect the function of the sensors as power requirements are very limited.

FIG. 2 schematically depicts the monitoring system of the invention according to a second embodiment. The casing sub 4B comprises an insulating gap 13. The gap 13 extends overall the circumference of the sub and insulates the casing/sub part above the gap from the casing/sub part below the gap. The powering means 7 are connected above and below the insulating gap 13 by a first connection 14A and second connection 14B, respectively. As the powering means 7 have a finite internal impedance, the voltage difference generated by the ingoing alternate current signal generates a current circulation in the powering means 7 between the connections 14A, 14B above and below the gap 13. This voltage/current is used to supply power to the sensor 5. In a way similar to the first embodiment, the voltage may also be used to communicate with the sensor 5. The return signal is modified by being further modulated by the data communication module 6 so that data information related to the sensor measurements can be encoded into the signal and transmitted to the surface equipment.

Figure 3:
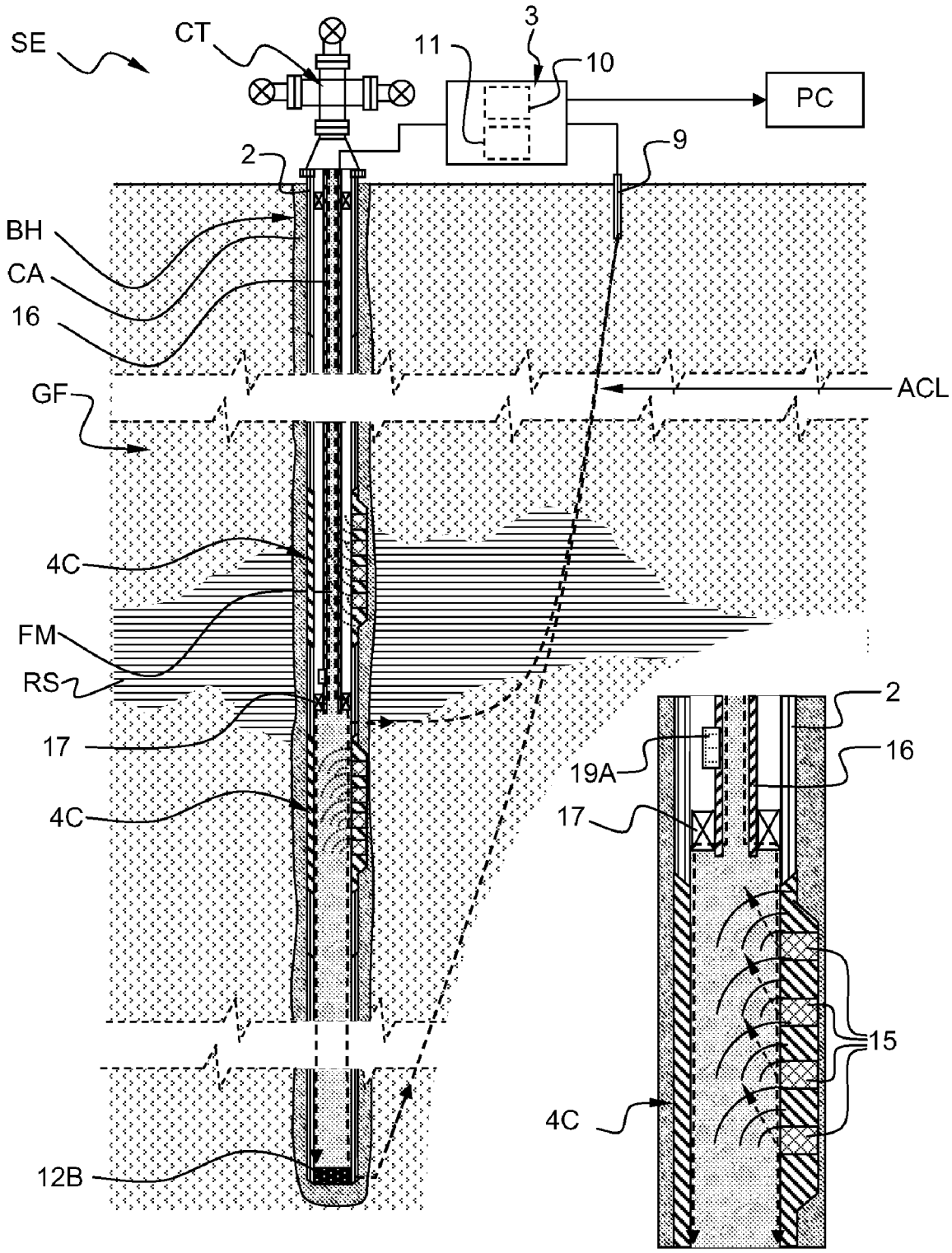
FIG. 3 schematically illustrates an onshore hydrocarbon well location and a monitoring system of the invention according to a third embodiment.
Figure 4:
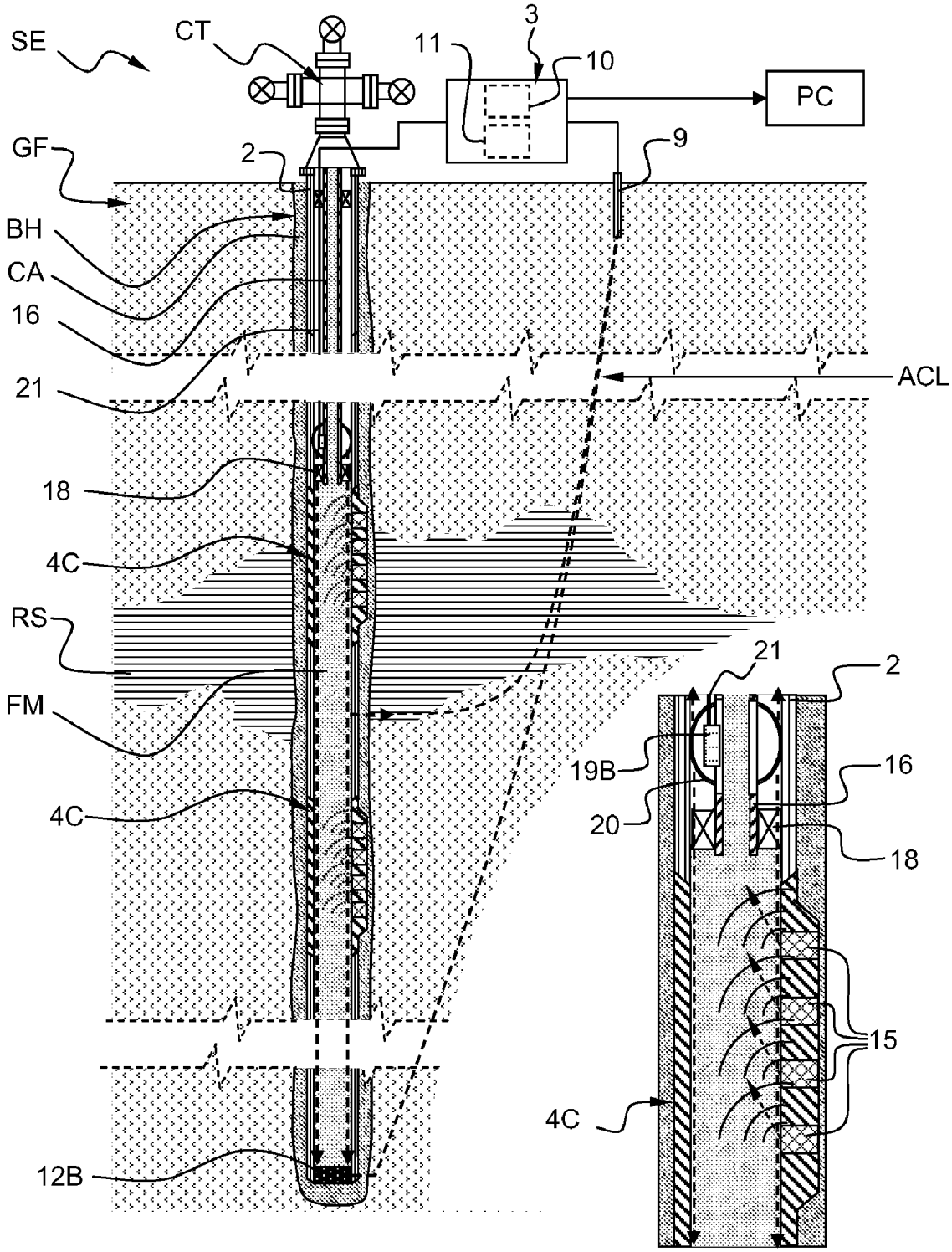
FIG. 4 schematically illustrates an onshore hydrocarbon well location and a monitoring system of the invention according to a fourth embodiment.
Figure 5:
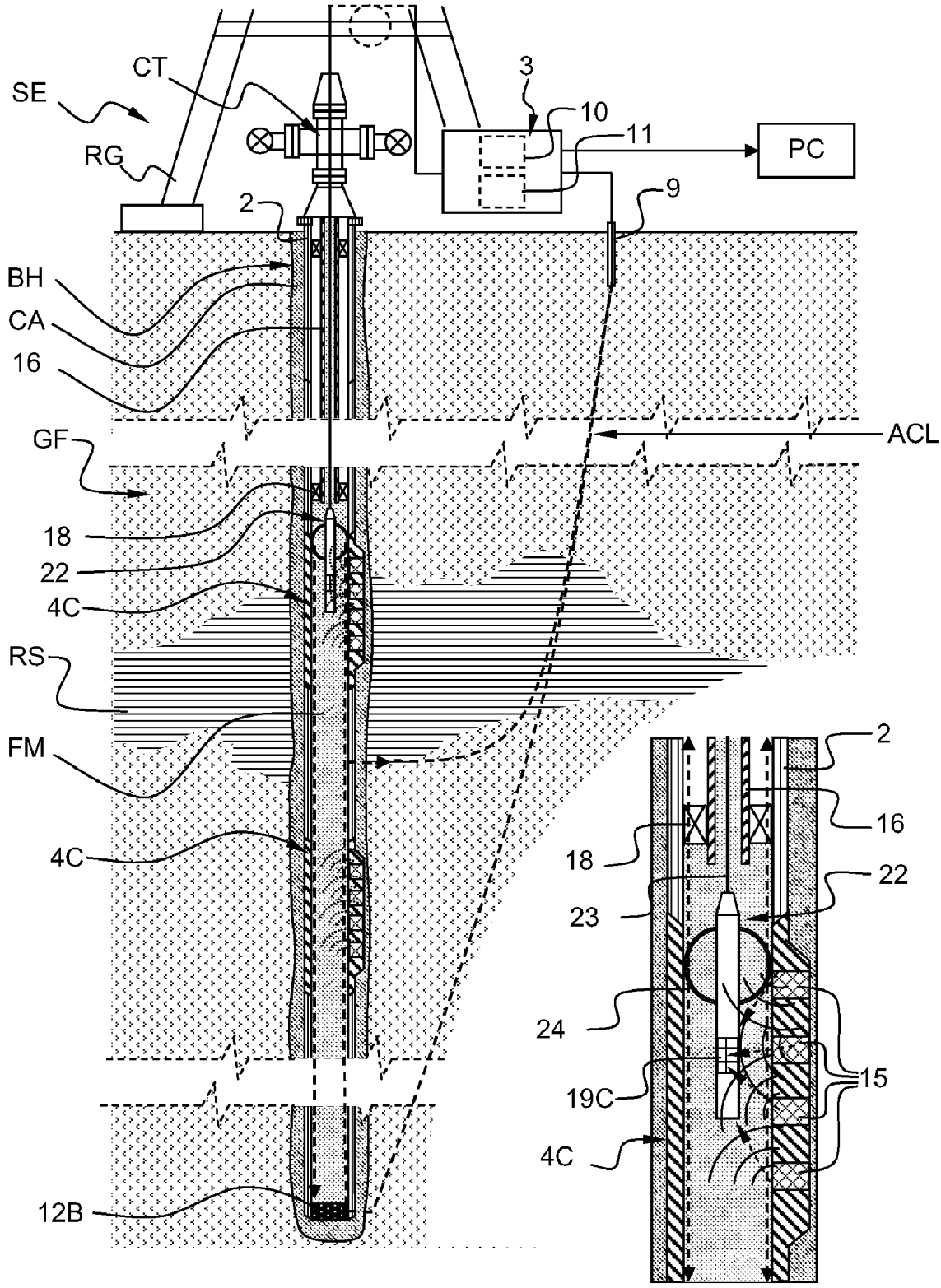
FIG. 5 schematically illustrates an onshore hydrocarbon well location and a monitoring system of the invention according to a fifth embodiment.

FIGS. 3, 4 and 5 depict the monitoring system of the invention according to a third, a fourth and a fifth embodiment, respectively.

A tubing string or production tubing 16 is inserted into the internal cavity defined by the piping structure 2. A packer 17 is further inserted between the production tubing 16 and the piping structure 2 for hydraulically isolating the annulus from the production conduit and enabling controlled production. While not shown in the drawings, the piping structure 2 may be perforated in order to hydraulically couple the reservoir RS to the piping structure and the tubing. A conductive casing shoe 12B may be positioned at the bottom of the borehole BH.

At least one casing sub 4C is installed downhole. It is conventionally coupled by its threaded ends to adjacent piping portions during the piping structure running operation. A plurality of sensor system 15 is mounted integrally within the sub. For example, the casing sub 4C comprises four sensor systems 15. Each sensor system 15 comprises various modules coupled and integrated together that provide sensing, wireless data communication, and powering functions. Though the Figures show two conductive casing subs 4C, it is apparent for a skilled person that this is not limitative as less or more casing subs can be mounted along the piping structure 2. Further, the casing subs 4C can be installed below or along the production tubing 16.

The power and communication module 3 is installed at the surface. The power and communication module 3 comprises a power supply and a communication device. The power supply comprises a voltage source or a current source supplying a time varying signal. Advantageously, the power supply may be an alternate current generator 10, for example providing a signal of 300 $V_{RMS}$, 10 $A_{RMS}$ and at a frequency from around 1 Hz to around 10 kHz. In the high frequency range, a skin effect may be generated in the conductive piping/tubing/casing. The communication device may be a modulator-demodulator (modem) device 11. Advantageously, the modem of the power and communication module operates according to a spread-spectrum scheme in order to tolerate noise and low signal.

FIG. 3 schematically illustrates the monitoring system of the invention according to the third embodiment. In the third embodiment, the packer is a conductive packer 17 that electrically couples the conductive tubing 16 to the piping structure 2.

The power and communication module 3 is coupled by a first connector to the conductive tubing 16 and by a second connector to a grounded return electrode 9. The grounded return electrode 9 is inserted into the soil at the surface and is thus coupled to the subsurface formation GF. The alternate current generator 10 injects an alternate current signal in the production tubing 16, the conductive packer 17, the conductive piping structure 2 and the subs 4C.

The power and communication module 3, the production tubing 16, the piping structure 2, the subs 4C and the geological formation GF form a path for the signal (indicated as dotted lines). Similarly to the first and second embodiments, the signal mainly propagates along the conductive tubing, the conductive packer, the conductive piping structure and also through the cement and the formation, and returns towards the grounded return electrode. An ingoing signal flows from the surface installed power and communication module 3 to the downhole installed subs 4C. Return signals flow from the conductive piping structure 2, in particular from the downhole installed sub 4C and the conductive casing shoe 12B towards the grounded return electrode 9 coupled to the surface installed power and communication module 3.

The monitoring system of the invention according to the third embodiment comprises a downhole intermediate module 19A integrated to the production tubing 16. The intermediate module 19A has the function of a repeater by providing wireless communication with the sensors system 15 and gathering the data information corresponding to the measurements of the sensors system 15. An intermediate module 19A is advantageous in deep reservoir configuration. As an example, the intermediate module 19A may be at a distance of the kilometers order from the surface while the sensors system 15 may be at distance of the hundreds of meters from the intermediate module 19A. In essence, the intermediate module 19A couples the surface installed power and communication module 3 to the sensors system 15. The downhole intermediate module 19A is connected to the surface installed power and communication module 3 via the conductive tubing 16. The electrical power of the ingoing signal provides power to the sensors system 15 and to the intermediate module 19A. The intermediate module 19A modulates its impedance which affects the level of the current in the time varying current lines up to the return electrode. The impedance modulation is performed such that the measurements of the sensor systems are encoded into the return signal. This modulation is decoded at the surface by the modulator/demodulator device 11. The extracted measurements can then be stored, processed, displayed and/or further used by appropriate storing/processing/displaying means, e.g. a personal computer PC in order to allow a controlled and optimized exploitation of the reservoir.

FIG. 4 schematically illustrates the monitoring system of the invention according to the fourth embodiment. The monitoring system according to the fourth embodiment differs from the third embodiment in that the packer is an insulating packer 18, in that the downhole intermediate module 19B is directly connected to the surface installed power and communication module 3.

The insulating packer 18 electrically decouples the conductive tubing 16 from the piping structure 2. The downhole intermediate module 19B is connected to the surface installed power and communication module 3 via a cable 21. The downhole intermediate module 19B comprises a conductive centralizer 20 contacting the piping structure 2 or sub 4C. Thus, the production tubing 16 is totally isolated.

The signal (indicated as dotted lines) mainly propagates through the cable 21 to the intermediate module 19B, through the conductive centralizer 20 to the conductive piping structure 2 and subs 4C and also through the cement CA and the formation GF, and returns towards the grounded return electrode 9. An ingoing signal flows from the surface installed power and communication module 3 to the downhole installed subs 4C. Return signals flow from the conductive piping structure 2, in particular from the downhole installed sub 4C and/or the conductive casing shoe 12B towards the grounded return electrode 9 coupled to the surface installed power and communication module 3.

The provision of power to the sensor, the retrieval of measurements and the transmission of gathered measurements to the surface are identical to the ones described in relation with the third embodiment. Alternatively, the retrieval of the measurements and the transmission of gathered measurements to the surface may be performed through the cable 21.

FIG. 5 schematically illustrates the monitoring system of the invention according to the fifth embodiment. The monitoring system according to the fifth embodiment differs from the third and fourth embodiment in that the downhole intermediate module 19C is fitted into a downhole tool 22.

The downhole tool 22 is suspended by a wireline 23 to an appropriate deployment device RG comprising a rig and various drums that are known in the art and will not be further described (partially shown on FIG. 5). The wireline 23 is connected to the surface installed power and communication module 3 and to the downhole intermediate module 19C. The tool 22 comprising the downhole intermediate module 19C may be run into the production tubing 16 and below the production tubing 16 section. An insulating packer 18 may electrically decouple the tubing from the piping structure.

The downhole intermediate module 19C has the same functions as the ones of the fourth embodiment, namely coupling the surface installed power and communication module 3 to the sensors system 15. When deployed, the tool 22 couples the surface installed power and communication module 3 to the piping structure 2 or subs 4C by means of a conductive centralizer 24 contacting the internal wall of the piping structure 2 or sub 4C.

The signal (indicated as dotted lines) mainly propagates through the wireline 23 to the intermediate module 19C of the downhole tool 22, through the conductive centralizer 24 to the conductive piping structure 2 and subs 4C and also through the cement CA and the formation GF, and returns towards the grounded return electrode 9. An ingoing signal flows from the surface installed power and communication module 3 to the downhole installed subs 4C. Return signals flow from the conductive piping structure 2, in particular from the downhole installed sub 4C and the conductive casing shoe 12B towards the grounded return electrode 9 coupled to the surface installed power and communication module 3.

The provision of power to the sensor, the retrieval of measurements, the transmission of gathered measurements to the surface and their alternatives are identical to the ones described in relation with the third and fourth embodiments.

Figures 6, 7:
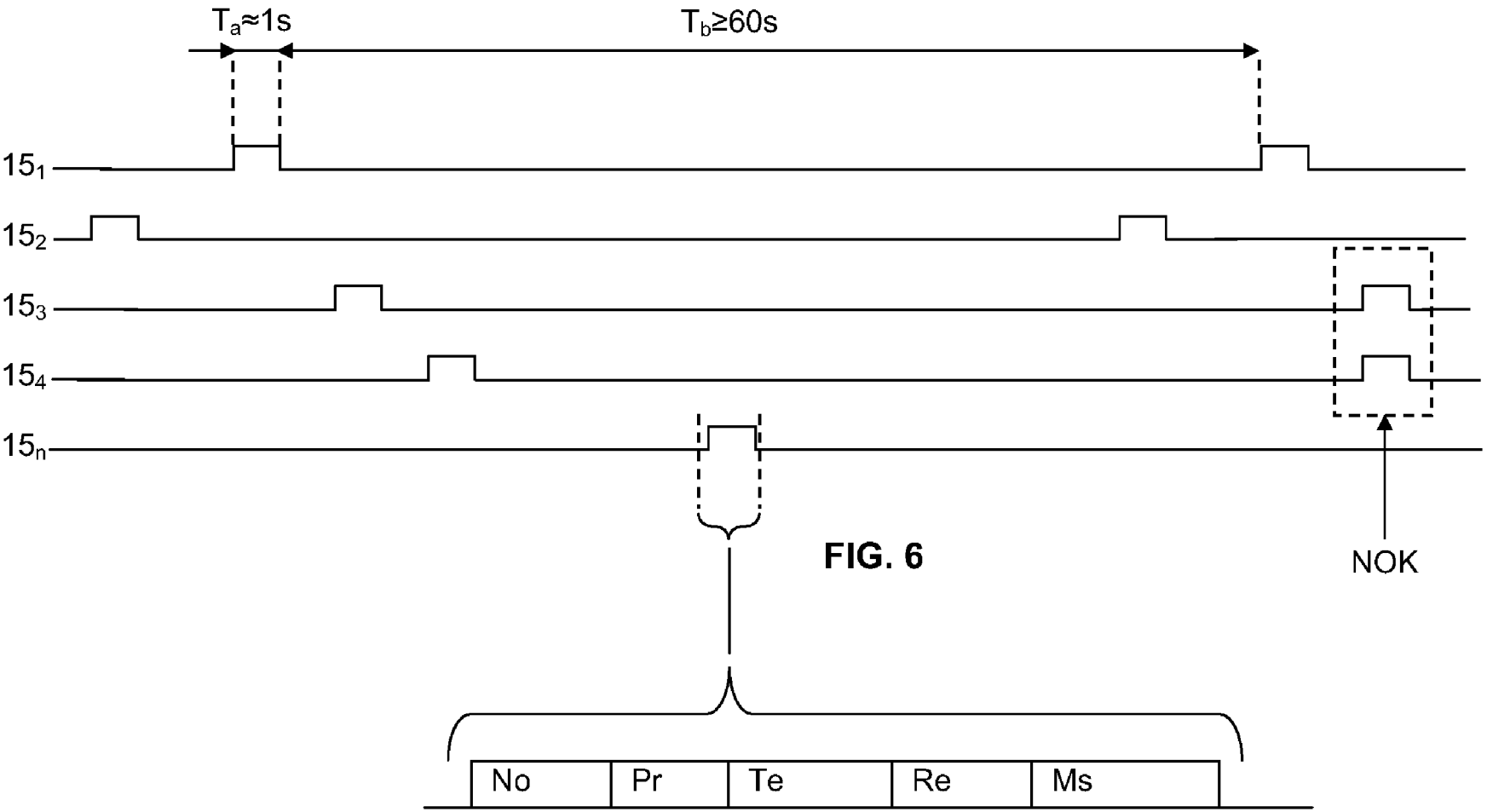
FIG. 6 is a time frame illustrating transmission of data from sensors in a monitoring system of the invention according to any one of the embodiments.
FIG. 7 illustrates in a detailed manner an example of data transmitted by a sensor of a monitoring system of the invention according to any one of the embodiments.

FIG. 6 is a time frame illustrating an example of transmission of data from sensors in a monitoring system of the invention according to any one of the embodiments. Each sensors system $\mathbf{15}_1$, $\mathbf{15}_2$, $\mathbf{15}_3$, $\mathbf{15}_4$, . . . $\mathbf{15}_n$ sends periodically a frame comprising encoded data information. For example, each frame may have a duration $T_a$ of 1 sec and each sensor may send a frame with a period $T_b$ of 60 sec. In the case where the frame transmissions of two or more sensors interfere together, the received transmissions are rejected (indicated NOK in FIG. 6). However, the probability of occurrence of such an interference is low. It can be further reduced by increasing the period $T_b$.

FIG. 7 illustrates in a detailed manner an example of data information transmitted by a sensors system 15. For example, the frame may comprise multiple portions, a first portion corresponds to a number No identifying the sensors system, a second portion corresponds to a pressure measurement Pr, a third portion corresponds to a temperature measurement Te, a fourth portion corresponds to a resistivity measurement Re, a fifth portion corresponds to a other type of measurement Ms.

The time frame of FIGS. 6 and 7 is only an example corresponding to continuous monitoring of downhole parameters. With the system of the invention, the downhole sensor can be polled on demand and/or their functions can be controlled remotely.

FINAL REMARKS

Though the invention was described in relation with onshore hydrocarbon well location, it will be apparent for a person skilled in the art that the invention is also applicable to offshore hydrocarbon well location.

Further, it will be apparent for a person skilled in the art that application of the invention to the oilfield industry is not limitative as the invention can also be used in others kind of monitoring system, e.g. underground water storage, underground gas storage, underground waste disposal, or any tubing (e.g. a pipeline).

Furthermore, though the borehole and the piping structure are shown as vertically oriented, they may also comprise portions that are tilted, or even horizontally oriented.

Finally, the invention also applies in segmented completions application where the completions are run into the borehole in at least two steps. The first step consists in placing a lower completion pipe at the bottom of the reservoir. The lower completion pipe may comprise sand-screen pipes or slotted liner pipes, and a gravel pack placed outside the sand-screens. The lower completion pipe can be equipped with a sub instrumented with powering means and sensors. The second step consists in landing an upper completion tubing. The upper completion tubing is latched into the lower completion pipe. The metallic pipes/tubing and/or the latching mechanism ensure the electrical connection between the piping structure of the casing and the completion pipes/tubing.

The drawings and their description hereinbefore illustrate rather than limit the invention.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A subsurface formation monitoring system comprising:

a conductive piping structure being positioned within a borehole (BH) extending into the subsurface formation (GF), a surface installed power and communication module, a downhole installed conductive casing sub threadedly coupled to adjacent piping portions of the conductive piping structure, the downhole installed conductive casing sub comprising at least one sensor mounted on the conductive casing sub, a data communication module for wireless communication of the sensor measurements to the surface installed power and communication module, and a powering means for providing power to the data communication module and the sensor, the at least one sensor, the data communication module and the powering means mounted integrally within the conductive casing sub and coupled together, the surface installed power and communication module being coupled to the conductive piping structure and to a grounded return electrode coupled to the subsurface formation (GF), and comprising an alternate current generator so as to define an ingoing signal path along the conductive piping structure and conductive casing sub, the ingoing signal flowing from the surface installed power and communication module to the downhole installed conductive casing sub, the ingoing signal transmitting power from the alternate current generator to the downhole installed conductive casing sub, wherein a return signal comprising the sensor measurements is transmitted through a return signal path (ACL) flowing from the downhole installed conductive casing sub to the surface installed power and communication module into the subsurface formation (GF) around the borehole (BH).

2. A subsurface formation monitoring system according to claim 1, wherein the powering means is a power harvesting means or an energy storage means.

3. A subsurface formation monitoring system according to claim 1, wherein the powering means is coupled to a toroid mounted in the conductive casing sub concentrically to the borehole (BH).

4. A subsurface formation monitoring system according to claim 1, wherein the sensor measures characteristic parameter of the formation (GF), or in the borehole (BH), or of the conductive piping structure.

5. A subsurface formation monitoring system according to claim 1, wherein the sensor is selected from the group consisting of a pressure sensor, a temperature sensor, a resistivity sensor, a conductivity sensor, a casing/tubing stress-strain sensor, a pH sensor, a chemical sensor, a flow rate sensor, an acoustic sensor, and a geophone sensor.

6. A subsurface formation monitoring system according to claim 1, wherein the ingoing signal further comprises commands sent from the surface installed power and communication module to activate functions of the downhole installed conductive casing sub.

7. A subsurface formation monitoring method according to claim 1, wherein the ingoing signal further comprises commands sent from the surface installed power and communication module to activate functions of the downhole installed conductive casing sub.

8. A subsurface formation monitoring system according to claim 1, wherein the conductive piping structure comprises a conductive casing.

9. A method of monitoring a subsurface formation comprising the steps of:

positioning a conductive piping structure within a borehole (BH) extending into the subsurface formation (GF), positioning a downhole installed conductive casing sub threadedly coupled to adjacent piping portions of the conductive piping structure, the downhole installed conductive casing sub comprising at least one sensor, a data communication module for wireless communication of the sensor measurements to a surface installed power and communication module, and a powering means for providing power to the data communication module and the sensor, the at least one sensor, the data communication module and the powering means mounted integrally within the conductive casing sub and coupled together, wherein the method further comprises the steps of:

coupling the surface installed power and communication module to the conductive piping structure and to a grounded return electrode coupled to the subsurface formation (GF), injecting an alternate current signal so as to define an ingoing signal path along the conductive piping structure and conductive casing sub, the ingoing signal flowing from the surface installed power and communication module to the downhole installed conductive casing sub, and a return signal path (ACL) into the subsurface formation (GF) around the borehole (BH), the return signal (ACL) flowing from the downhole installed conductive casing sub to the surface installed power and communication module, the ingoing signal transmitting power from the alternate current generator to the downhole installed conductive casing sub, and wherein:

the return signal transmitting the sensor measurements to the surface installed power and communication module.

10. A subsurface formation monitoring method according to claim 9, wherein the conductive piping structure comprises a conductive casing.

* * * * *